United States Patent [19]

Gomez

[11] Patent Number: 4,578,888

[45] Date of Patent: Apr. 1, 1986

[54] FISH MOBILE STRUCTURE

[76] Inventor: Howard Gomez, 555 Paularino Ave., No. P104, Costa Mesa, Calif. 92626

[21] Appl. No.: 598,230

[22] Filed: Apr. 9, 1984

[51] Int. Cl.[4] ..... G09F 19/08

[52] U.S. Cl. ..... 40/411; 446/361; 446/362; 446/363; D22/28; D22/27; D21/62

[58] Field of Search ..... 40/412, 411, 417, 418, 40/421, 422, 427, 212, 214; 446/361, 362, 363, 351, 359; D22/27, 28; D21/62, 68, 69

[56] References Cited

U.S. PATENT DOCUMENTS

| | | | |
|---|---|---|---|
| 2,472,639 | 6/1949 | Wickens | D22/28 |
| 2,526,077 | 10/1950 | Jurczak | D22/28 |
| 2,567,787 | 9/1951 | Sahutski | D22/28 |
| 2,685,145 | 8/1954 | Dean | D22/28 |
| 3,271,897 | 9/1966 | Gelinas | 40/412 |
| 3,290,817 | 12/1966 | Kravath | 40/412 |
| 4,223,475 | 9/1980 | Hills | 446/363 |
| 4,425,388 | 1/1984 | Oppenheimer, Jr. | 446/362 |

FOREIGN PATENT DOCUMENTS

| | | | |
|---|---|---|---|
| 2335456 | 1/1975 | Fed. Rep. of Germany | 446/362 |
| 3203247 | 9/1983 | Fed. Rep. of Germany | 446/361 |
| 2475261 | 8/1981 | France | 446/361 |
| 2495003 | 6/1982 | France | 446/351 |

*Primary Examiner*—Gene Mancene
*Assistant Examiner*—James Hakomaki
*Attorney, Agent, or Firm*—Poms, Smith, Lande & Rose

[57] ABSTRACT

A fish mobile structure adapted to be displayed in a windy environment, such as near an open window or in a patio area, or the like, is disclosed, including a plurality of segmented portions collectively forming a fish body structure, each of the segmented portions being joined in spaced-apart relationships to one another by a plurality of strings, a plurality of fin structures secured to portions of the fish body structure by means of strings and disposed in spaced-apart relationship thereto, and weights secured to the segmented portions to maintain the fish body structure in a vertical arrangement and to draw the strings taunt to allow and encourage pivotal movement of the various string-joined together portions of the mobile when such are moved by wind currents flowing thereabout.

8 Claims, 4 Drawing Figures

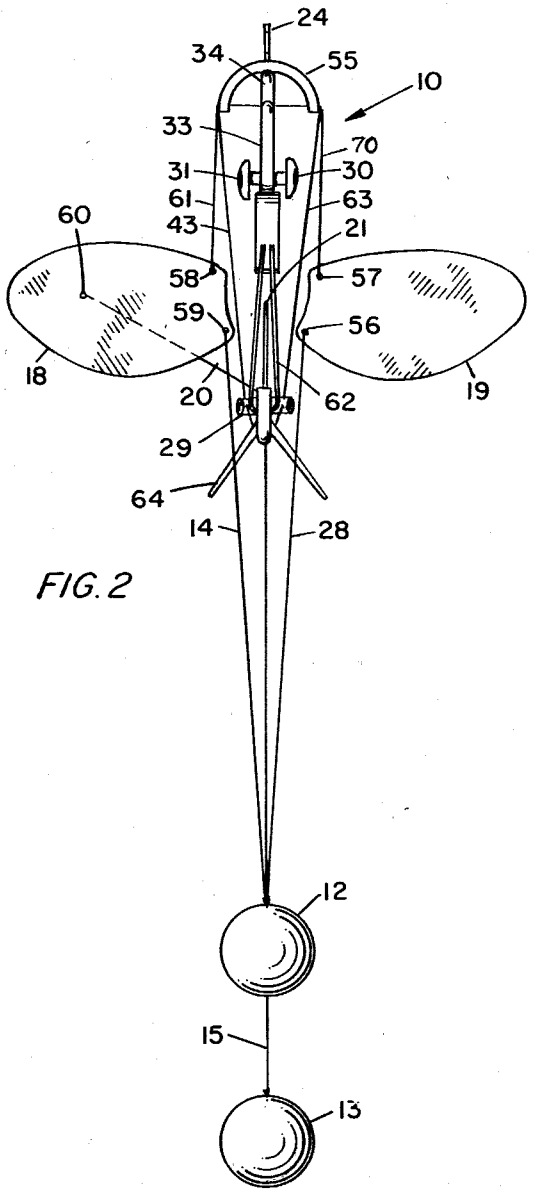
FIG. 2
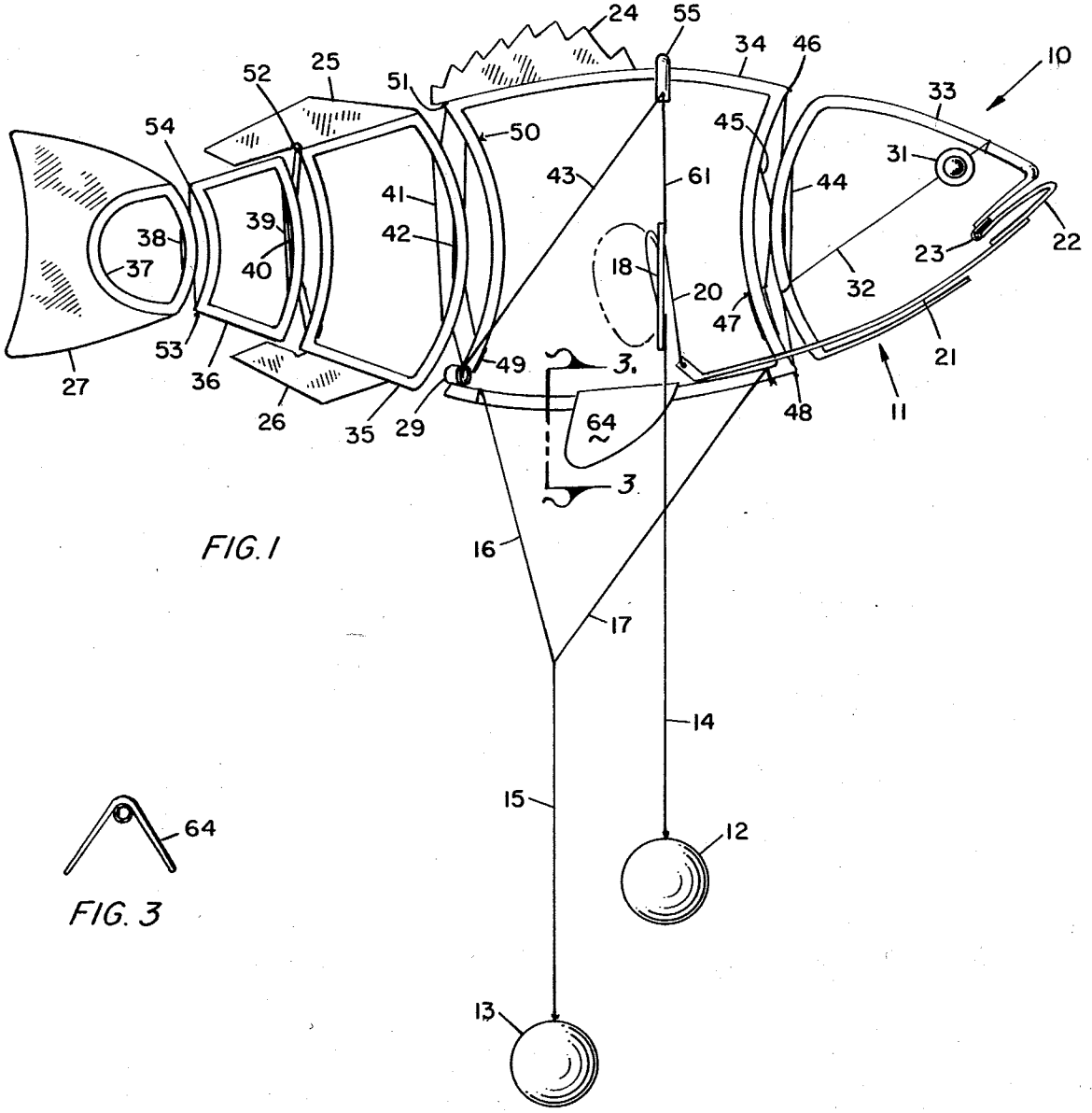
FIG. 1
FIG. 3

FISH MOBILE STRUCTURE

BACKGROUND OF THIS INVENTION

1. Field of the Invention

The field of the invention relates to animated wind mobiles, and more particularly, to weighted mobiles having elements interconnected together by torsional string elements to produce movement of one or more elements when another element is blown or moved by wind currents.

2. Description of the Prior Art

The prior art is replete with various and derverse windblown activated mobiles. Various designs and arrangements have been employed by numerous other designers in the past.

However, none have formed or constructed the unique and novel segmented fish body mobile characterized in full by the disclosure set forth herein.

The animated interconnected elements forming the mobile, weighted to maintain verticularity while the various interconnected elements are operably connected by torsional string elements which are animated by wind currents flowing thereabout is believed to be particularly unique in the mobile art.

SUMMARY OF THE INVENTION AND OBJECTS

Fundamentally, the present invention relates to wind blown or animated mobiles. Particularly, this mobile comprises a fish mobile structure adapted to be displayed in a windy environment, such as near an open window or a patio area or the like, is disclosed, including a plurality of segmented portions collectively forming a fish body structure, each of the segmented portions being joined in spaced apart relationships to one another by a plurality of strings, a plurality of fin structures secured to portions of the segmented structures by means of strings and disposed in spaced apart relationship thereto, and weight means secured to portions of the segmented structures to maintain the plurality of structures in a vertical arrangement and to draw the strongs taunt to create a torsional spring element to allow and encourage pivotal movement of the various string-joined together portions of the mobile which may be easily moved by wind currents flowing therefrom.

It is an object of the present invention to provide a wind-blown and animated mobile which is greatly distinguished from the prior mobiles produced.

Another important and primary object of the instant invention is to provide a mobile structure which maintains its verticularity during the animation due to wind currents flowing over the various elements of the mobile.

It is a still further significant and important object of the present invention to provide a wind activated mobile in the form of a fish, having separate segments arranged in interconnecting, but spaced-apart relationship to one another, by a plurality of string torsional elements, whereby each segmented portion is caused to move with respect to each other.

Another object of the invention is to provide an animated fish mobile which has a moving mouth and pectoral fins.

Other features and objects of the present invention will become more clearly known and understood as the description of the invention is set forth in greater detail by the Drawings and Claims which follow hereinafterwards.

BRIEF DESCRIPTION OF THE DRAWINGS

FIG. 1 is a side elevational view of the fish mobile structure disclosed herein.

FIG. 2 is a front elevational view of the invention set forth herein.

FIG. 3 is a view of the fin arrangement taken along Plane 3—3 of FIG. 1.

DESCRIPTION OF THE PREFERRED EMBODIMENT

Figure 4:
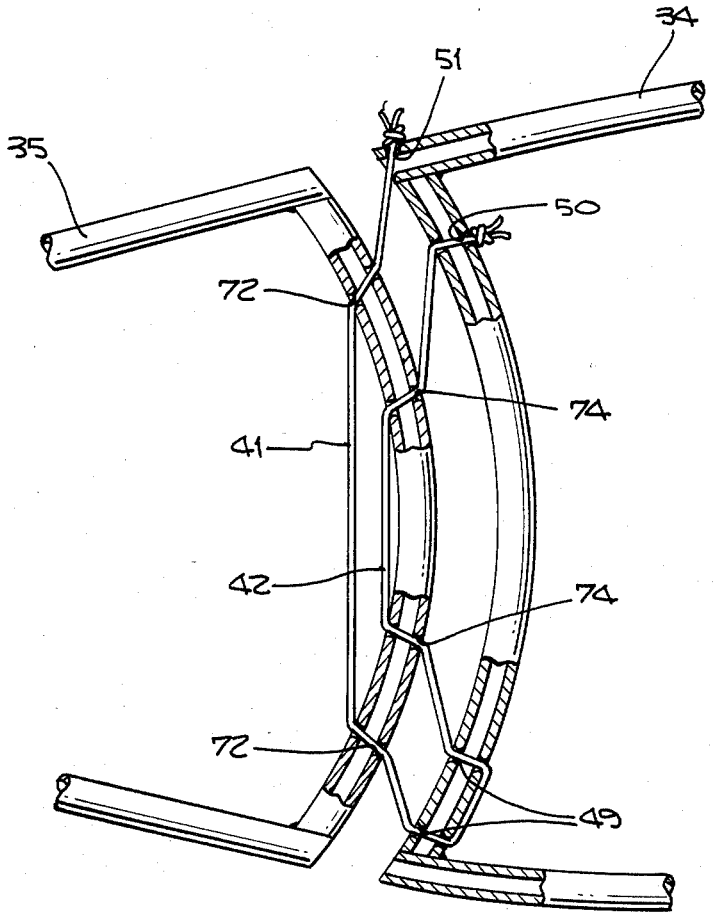
FIG. 4 is an enlarged view, partly in cross section, of one of the hinge joints of the fish mobile structure of FIG. 1.

With continued reference now to the drawings herein, there is shown a new and unique fish mobile generally indicated at 10.

With special emphasis now on FIG. 1, there is shown a fish mobile at 10 including a head portion 33, a first intermediate body section 34, a second intermediate body section 35, a third intermediate body section 36, and a tail 37. Each of the individual sections 33, 34, 35, 36 and 37 are interconnected to adjacent sections by means of a plurality of torsional string elements, as hereinafterwards detailed in greater particularity.

It should be noted that the entire first intermediate section 34 is interconnected to a plurality of weighted objects 13, 12 which are attached to the first intermediate body section 34 by means of a plurality of strings 15, 16 and 17 and 14, respectively. These weighted objects 12, 13 provide the force necessary to maintain this body section 34 in a vertically oriented position. Typically, the other, or top portion of the first intermediate body section 34 is secured by means of another string element (not shown) which is attached to the semi-circular ring element 55 which rides on the upper portion of the body section 34.

In the head portion 33, a pair of simulated fish eyes 30, 31 are held in their appropriate and respective positions relative to the head 34 by means of a string element 32 which is secured at its opposite ends to the frame forming the head portion 34.

Turning our attention specifically now to FIG. 2, a pair of pictoral fins 18, 19 are secured to the first intermediate body portion 34 by means of a plurality of string elements 14, 28 and 61, 70 which are respectively anchored at their opposite ends to the semicircular ring element 55 and aperature 59 in the pectoral fin 18 and the weighted object 12 (for string 14) and for string 61, the aperture 58 in the pectoral fin 18. String 28 is anchored between the weighted object 12 and the aperture 56 in pectoral fin 19. String 70 is anchored between the weighted object 12 and the aperture 57 of pectoral fin 19. In this arrangement, when the wind current flow about and against the pectoral finds 18, 19, the fins move about the axis formed by the string elements attached hereto; namely, string elements 61, 14 with respect to pectoral fins 18 and string elements 70, 28 with respect to pectoral fin 19.

As additional fin 64 arrangement is provided as shown in the Drawings, and more specifically, in FIG. 3, the purpose of this fin 64 is to provide additional surface area inclined at an angle with respect to the pectoral fins 18, 19 by which the wind current can be deflected and thereby cause the first intermediate body portion 34 to move creating an animated effect on the over-all mobile structure 10.

As can be clearly seen in the Drawings herein, the head portion 33 is secured to the first intermediate body 34 by means of a plurality of string elements 44, 45 which are anchored at their mid-section to the frame of the head portion 33 and at their opposite ends to the top and bottom of the frame of the first intermediate body portion 34 at 46, 48 respectively. This arrangement allows for pivotal movement of the fish head portion 33 and the first intermediate body portion 34 about a vertically arrayed axis defined by the plurality of string elements 44, 45. Additionally, such string elements 44, 45 maintain the head portion 33 in a spaced-apart relationship with respect to the first intermediate body portion 34, thereby insuring integrity of the fish shape or contour and maintaining freedom of movement with respect to each element.

The opposite end of the first intermediate body portion 34 which faces the second intermediate body portion 35 is secured thereto in a fashion similar to the head 33 and first intermediate body portion 34 as described previously. A plurality of string elements 41, 42 are secured to the frame of the second intermediate body 35 via apertures (not identified) at the mid-section of the string elements 41, 42. The opposite ends of the string elements 41, 42 are attached at apertures 51, 50 and 49. The interacting relationship created is the same as that previously described between the head portion 33 and the first intermediate body 34.

The third intermediate body 36 is similarly anchored in pivotal, spaced-apart relationship between the second intermediate body 35 and the tail 37 via a plurality of string elements 39, 40 and 37, 38. String elements 39, 40 couple the third intermediate body 36 to the second intermediate body 35 with the ends connected at 52, located at the top of the second intermediate body 35 and at the bottom of the frame thereof via aperatures (not numbered) in said frames. String element 38 is anchored at 53, 54 in the third intermediate body portion 36 via aperatures (unnumbered) in the frame of the tail portion 37.

It should be noted that additional wind catching or reacting surfaces are provided by the dorsal fin 27 secured by the frame of the tail portion 37, the top and bottom fins 25, 26 mounted on the top and bottom of the frame of the second intermediate body portion 35, and the large top fin 24 which is secured to the top of the first intermediate body 34.

Turning now to the animated mouth portion 22 which is, of course, mounted to the fish head portion 33, the arm 21 is secured at one end to the end of the mouth 22 which is hinged at the opposite end at 23 to the head 33 frame. The opposite end of the arm 21 is secured to a string element 20 which is laterally displaced and secured to the pectoral fin 18 at aperture 60 therein. When the pectoral fin 18 is caused to move in the wind, the fin 18 is pivotally displaced back and forth about a vertical axis as previously discussed. Incidentally, reference may be made to FIG. 4 of the drawings for the details of the string hinge securing arrangements. A plurality of string elements 41, 42 are secured to the frame of the second intermediate body 35, via apertures 72 for string element 41, and apertures 74 for string element 42, at the mid-section of the string elements 41, 42.

Preferably, the mobile should be constructed of durable materials, such as metals and/or plastics.

While I have disclosed a preferred and particular emodiment of my invention herein in the Drawings, it should be clearly understood that those skilled in the mobile art will and can make changes and modifications to the subject embodiment without departing from the spirit and scope of the present invention which should only be limited by the claims appended hereto.

I, claim:

1. A fish mobile, comprising:

(a) a separate head portion having a forward and a rear portion;

(b) a first intermediate and separate body section having a forward and a rear portion, the forward portion of the first intermediate body section being pivotally hinged by at least one string member having torsional characteristics to the rear portion of the head portion;

(c) a second intermediate and separate body section having a forward and a rear portion, the forward portion of the second intermediate body section being pivotally hinged by at least one string member having torsional characteristics to the rear portion of the first intermediate body section;

(d) a third intermediate and separate body section having a forward and a rear portion, the forward portion of the second intermediate body section being pivotally hinged by at least one string member having torsional characteristics to the rear portion of the second intermediate body section;

(e) a separate tail portion having a forward and a rear portion, the forward portion being pivotally hinged by at least one string member having torsional characteristics to the rear portion of the third intermediate body section;

(f) means disposed beneath said body sections for maintaining the first intermediate body section in a vertical position when the first intermediate body section is suspended or hung by a string or the like from a relatively stationary structure.

2. The fish mobile of claim 1, further comprising in the head portion:

(a) an open frame shaped in the form of a generally triangularly shaped fish head;

(b) a pair of eyes, said eyes being suspendedly hung in position with a pair of strings, the opposite ends of the strings being secured to the forward and rear portions of the open frame respectively so that the eye is disposed more forwardly then rearwardly within the open frame defining the fish head portion; and (c) a mouth, the upper lip portion of which is fixedly formed as a part of the fish head portion formed by said open frame, and a lower lip portion hinged at the rearwardmost portion of its top portion to the upper lip and moveably disposed with respect thereto, the lower lip further having a bottom portion formed in the shaped of an enlongated lever arm with said lever arm being secured at the opposite end thereof to a string which is anchored to a pectoral fin vertically hinged via a pair of strings to the first intermediate body section, so that when said pectoral fin is pivotally moved, the string securing said lever arm to said pectoral fin causes the lever arm to move up and down and in turn, causing the lower lip of the fish head to move up and down.

3. The fish mobile of claim 1, further comprising a top fin secured to the upper portion of said first intermediate body portion.

4. The fish mobile of claim 1, further comprising a dual lower fin secured to the lower portion of said first intermediate body portion.

5. The fish mobile of claim 1, further comprising:

(a) a second weighted object disposed beneath the first intermediate portion; and (b) string means secured to said first intermediate portion and said second weighted object.

6. The fish mobile of claim 1, further comprising:

(a) an upper fin secured to the top of said second intermediate portion; and (b) a lower find secured to the bottom of said second intermediate portion.

7. The fish mobile of claim 1, further comprising a tail fin secured to the tail portion and extending rearwardly therefrom.

8. The fish mobile of claim 1, wherein said first, second and third intermediate body sections are pivotally hinged to each other by a pair of string members having torsional characteristics, and the forward portion of said first intermediate body section is pivotally hinged by a pair of string members having torsional characteristics to the rear portion of said head portion.

* * * * *